US009832565B2

(12) United States Patent
Zhang et al.

(10) Patent No.: US 9,832,565 B2
(45) Date of Patent: Nov. 28, 2017

(54) SPEAKER SOUND HOLE DEVICE

(71) Applicant: GOERTEK INC., Shandong (CN)

(72) Inventors: Jun Zhang, Shandong (CN); Chengfei Zhang, Shandong (CN); Xinfeng Yang, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/307,903

(22) PCT Filed: Apr. 1, 2015

(86) PCT No.: PCT/CN2015/075661

§ 371 (c)(1),
(2) Date: Oct. 31, 2016

(87) PCT Pub. No.: WO2015/165318

PCT Pub. Date: Nov. 5, 2015

(65) Prior Publication Data

US 2017/0055065 A1 Feb. 23, 2017

(30) Foreign Application Priority Data

Apr. 30, 2014 (CN) ..... 2014 2 0218897 U

(51) Int. Cl.
*H04R 1/02* (2006.01)
*H04R 1/28* (2006.01)
*H04R 1/32* (2006.01)

(52) U.S. Cl.
CPC ..... *H04R 1/2803* (2013.01); *H04R 1/323* (2013.01); *H04R 1/025* (2013.01); *H04R 1/2849* (2013.01); *H04R 2499/11* (2013.01)

(58) Field of Classification Search
CPC ..... H04R 1/025; H04R 1/323; H04R 1/2803; H04R 1/2849; H04R 2499/11
See application file for complete search history.

(56) References Cited

U.S. PATENT DOCUMENTS 3,569,638 A 3/1971 Schoengold
8,885,867 B1 * 11/2014 Tai ..... H04R 1/345 381/388

(Continued)

FOREIGN PATENT DOCUMENTS

CN 201063836 Y 5/2008
CN 202488632 U 10/2012

(Continued)

OTHER PUBLICATIONS

International Search Report dated Jun. 29, 2015 in corresponding Application No. PCT/CN2015/075661; 2 pgs.

(Continued)

*Primary Examiner* — Brian Ensey
(74) *Attorney, Agent, or Firm* — Maier & Maier, PLLC

(57) ABSTRACT

A speaker sounding hole device includes a speaker single-unit front cover and a module housing. The speaker single-unit front cover is rectangular, the long edges and/or short edges of the speaker single-unit front cover are provided with open grooves, and the speaker single-unit front cover and the module housing are correspondingly assembled by means of the open grooves. The speaker single-unit front cover provided with the open grooves and the module housing form a front cavity of the speaker sounding hole device. Spaces formed by the open grooves are connected with the front cavity of the speaker sounding hole device to form a sounding channel of the speaker sounding hole device. The device can solve the problems of high cost, long tuning time of the product performance, poor sounding effects and low product efficiency.

6 Claims, 3 Drawing Sheets

(56) References Cited

U.S. PATENT DOCUMENTS

| | | | | |
|---|---|---|---|---|
| 9,525,933 | B2 * | 12/2016 | Chen | H04R 1/2842 |
| 2014/0023224 | A1 * | 1/2014 | Tao | H04R 1/02<br>381/412 |

FOREIGN PATENT DOCUMENTS

| | | | |
|---|---|---|---|
| CN | 103139683 | A | 6/2013 |
| CN | 203368742 | U | 12/2013 |
| CN | 203840517 | U | 9/2014 |

OTHER PUBLICATIONS

Notice of Allowance dated Jul. 30, 2014 in corresponding CN Application No. 201420218897.0; 2 pgs.

* cited by examiner

SPEAKER SOUND HOLE DEVICE

TECHNICAL FIELD

The present disclosure relates to the technical field of acoustoelectric conversion, more specifically, to a speaker sound hole device.

BACKGROUND ART

With the social progress and technical development, electronic products, such as cell phones and TVs, become smaller in size and gradually thinned in recent years, and the requirements for the performance of the electronic products become more and more critical, and thus, the related electronic parts of the electronic products are required to be smaller in size and thickness and improved in performance and consistency.

For appearance structure, speaker modules of the electronic products, such as, cell phones, TVs and the like, should be designed with a structure emitting sound at a lateral side, and an integrated design for emitting sound at a lateral side is usually adopted so as to improve the performance of the speaker and improve its sound quality due to the limitation of the overall height of the product.

However, when such an integrated design for emitting sound at a lateral side is adopted, the height space of the module emitting sound at a lateral side is relatively lower, and since the module emitting sound at a lateral side is directly mounted in the speaker unit, the channel for emitting sound of the front cavity is relatively smaller, which affects the performance of the product, and the cost of the product adopted this scheme is relatively high, and the time needed for the product debugging is long, and thus the production efficiency of the product is affected.

Thus, it is required to provide a new design structure for sound hole of the speaker unit to solve the above problem.

SUMMARY OF THE INVENTION

In view of the above problems, the objective of the present application is to provide a speaker sound hole device to solve the problems of high cost, long debugging time of the product performance, poor sound effects, and low product efficiency of the speaker products.

A speaker sound hole device provided by the present application comprises a front cover of a speaker unit and a module housing, wherein the front cover of the speaker unit is in a rectangular shape, and at least one open groove is provided at a long side and/or a short side of the front cover of the speak unit, the front cover of the speak unit is correspondingly assembled with the module housing through the open groove;

a front cavity of the speaker sound hole device is formed by the front cover of the speaker unit, which is provided with the open groove, and the module housing, and a sound channel of the speaker sound hole device is formed by a space defined by the open groove together with the front cavity of the speaker sound hole device.

In addition, preferably, two or four open grooves are provided at the long side and/or short side of the front cover of the speaker unit.

In addition, preferably, the front cover of the speaker unit is provided with mounting direction holes for the speaker unit.

In addition, preferably, the number of the mounting direction holes for the speaker unit is one or two.

In addition, preferably, a gap of the sound channel is a sum of a distance from a top to a bottom of the open groove and a distance from the front cover of the speaker unit to the module housing.

In addition, preferably, the gap of the sound channel of the speaker sound hole device is 0.76 mm As can be seen from the above technical scheme, in the speaker sound hole device provided by the present application, the design of the front cover of the speaker unit may be optimized in such a way that open grooves are provided on the front cover so as to match with the module housing, which enables the front cavity to emit sound more smoothly, and enables the maximization of the sound channel in the case of the limitation on the overall height of the module, thus improving the performance of the products and tone quality; and the embedded structure of the speaker unit which is applied to the module housing emitting sound at lateral side enables that the module housing may be assembled with the speaker unit directly, thereby improving production efficiency and lowering costs.

BRIEF DESCRIPTION OF THE DRAWINGS

By referring to the descriptions with reference to the accompanying drawings and the contents of the claims, and with a full understanding of the present application, other purposes and results of the present application will become more clear and easily understood. In the drawings:

FIGS. 3Ab, 3Bb, 3Cb and 3Db are section views illustrating the structure of the speaker taken along the long sides of the front cover, i.e., line A-A in FIG. 3Aa, line B-B in FIG. 3Ba, line C-C in FIG. 3Ca, and line D-D in FIG. 3Da according to the embodiment of the present application, respectively;

FIGS. 4Ab, 4Bb, 4Cb and 4Db are section views illustrating the structure of the speaker taken along the short sides of the front cover, i.e., line A-A in FIG. 4Aa, line B-B in FIG. 4Ba, line C-C in FIG. 4Ca, and line D-D in FIG. 4Da according to the embodiment of the present application, respectively.

Figure 1:
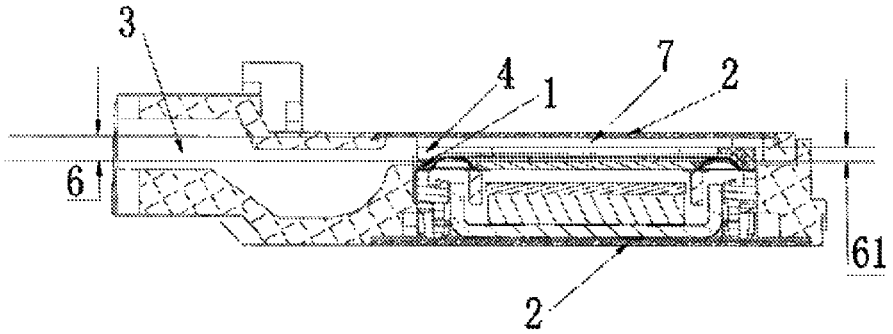
FIG. 1 is a schematic view illustrating the structure of the sound hole device of the speaker according to the embodiment of the present application.

Wherein, the reference numerals comprise: front cover 1 of the speaker unit, module housing 2, sound channel 3, open groove 4, mounting direction hole 5 for the speaker unit, gap 6 of sound channel, distance 61 between end portion and bottom of open grooves, front cavity 7.

Similar reference numerals in all figures indicate similar or corresponding features or functions.

DETAILED DESCRIPTION OF THE EMBODIMENTS

In the existing integrated design for the speaker emitting sound at lateral side, the front cover of the speaker unit is a traditional front cover, and meanwhile, the height of the space of the module housing is relatively lower, and the speaker unit is directly mounted into the module housing, and at this time, the front cover of the speaker unit and the module housing form a front cavity and a sound channel. The distance between the top and the bottom of the sound channel is 0.32 mm, and the sound channel formed by this means is relatively smaller, which will affect the sound effect of the speaker.

In the present application, the front cover of traditional speaker unit is improved in view of the above mentioned problem existing in the prior art, that is, open grooves are provided at the long side or short side of the front cover of the speak unit, and the front cover of the speaker unit provided with open grooves and the module housing are correspondingly matched with each other, such that the gap between the top and the bottom of the sound hole formed therebetween is enlarged, which facilitates the front cavity to emit sound smoothly, thereby effectively improving the sound effect of the product.

Particular embodiments of the present application will be described with reference to the accompanying drawings.

Figure 2:
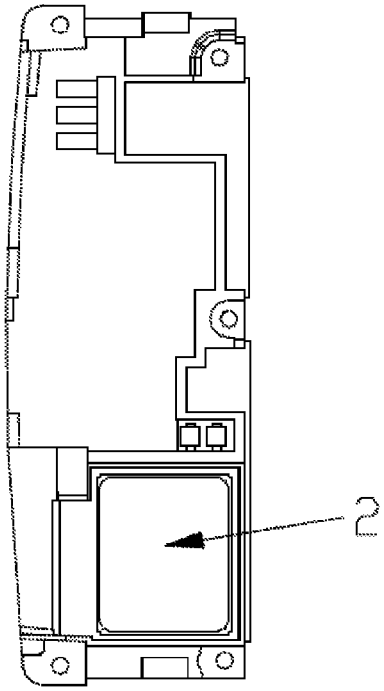
FIG. 2 is a schematic view illustrating the planar structure of the speaker with a front cover having an open groove according to the embodiment of the present application.

FIG. 1 illustrates the structure of the sound hole device of the speaker according to the embodiment of the present application; FIG. 2 illustrates the planar structure of the speaker with a front cover having open grooves according to the embodiment of the present application;

FIGS. 3A, 3B, 3C and 3D illustrate the structure of the long side of the front cover of the speaker according to the embodiment of the present application, respectively, and FIGS. 4A, 4B, 4C and 4D illustrate the structure of the short side of the front cover of the speaker according to the embodiment of the present application, respectively.

As shown in FIG. 1 and FIG. 2, the sound hole device of the speaker provided in the present application comprises a front cover 1 of the speaker unit and a module housing 2.

Wherein the front cover 1 of the speaker unit is in a rectangular shape, and at least one open groove 4 is provided at the long side and/or short side thereof, and the front cover of the speak unit 1 is correspondingly assembled with the module housing 2 through the open grooves 4. A front cavity 7 of the sound hole device of the speaker is formed by the front cover of the speak unit 1 provided with the open grooves and the module housing 2. The space defined by the open grooves 4 of the front cover 1 of the speak unit is in communication with the front cavity 7 of the sound hole device of the speaker so as to form a sound channel of sound hole device of the speaker (not shown in the figures).

That is, the open grooves 4 enlarge the sound channel formed between the front cover 1 of the speaker unit and the module housing 2 to a certain extent.

Particularly, as shown in FIGS. 3A, FIG. 3B, FIG. 3C and FIG. 3D, and FIG. 4A, FIG. 4B, FIG. 4C and FIG. 4D, in the present application, at least one open groove 4 is provided at the long side or short side of the front cover 1 of the speaker unit, that is, one open groove, or two or four open grooves may be provided at the long side of the front cover 1 of the speaker unit, and one open groove, or two or four open grooves may be provided at the short side of the front cover of the speaker unit.

It should be noted that, in the present application, when there is only one sound hole in the sound hole device of the speaker unit, one open groove, or two or four open grooves 4 may be provided at the long side of the front cover of the speaker unit according to the requirements of the product, or one open groove, or two or four open grooves 4 may be provided at the short side of the front cover of the speaker unit. At this time, in order to increase production efficiency and lower the cost, it is unnecessary to provide open grooves 4 at the long side and short side of the front cover 1 of the speaker unit at the same time. Meanwhile, mounting direction holes 5 for the speaker unit are further provided on the front cover 1 of the speaker unit, and the number of the mounting direction holes for the speaker unit is one or two.

Figure 3A:
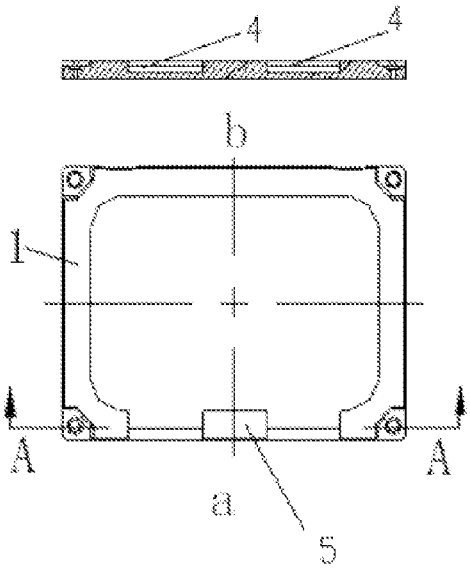
FIGS. 3Aa, 3Ba, 3Ca and 3Da are schematic views illustrating the front cover of the speaker according to the embodiment of the present application, respectively.

Specifically, in the embodiment as shown in FIGS. 3Aa and 3Ab, there is only one lateral sound hole in the speaker sound hole device, and there are two open grooves 4 provided at one of the long sides of the front cover of the speaker unit, and the mounting direction holes 5 for the speak unit are used for mounting the speaker unit, and there is only one mounting direction hole 5 for the speaker unit provided at one of the long sides of the front cover of the speaker unit, and thus, when the speaker unit is being mounted, the mounting direction of the speaker unit is determined based on mounting direction hole 5 for the speaker unit.

Figure 3B:
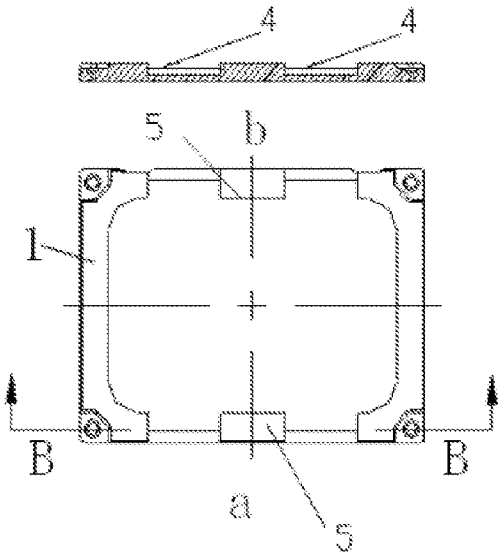

In the embodiment as shown in FIGS. 3Ba and 3Bb, there is only one sound hole in the speaker sound hole device, there are two open grooves 4 provided at each of the long sides of the front cover of the speaker unit, and there are four open grooves 4 in total, and the mounting direction holes 5 for the speaker unit are provided at each of the long sides of the front cover of the speaker unit, respectively. In the embodiment as shown in FIG. 3B, two mounting direction holes 5 for the speaker unit are provided, and thus, when the speaker unit is being mounted, the mounting direction of the speaker unitdoes not need to be determined based on any directions. By this way, the speaker unit is easy to be mounted, and it becomes more easier and convenient during the operation, which may improve production efficiency.

Figure 3C:
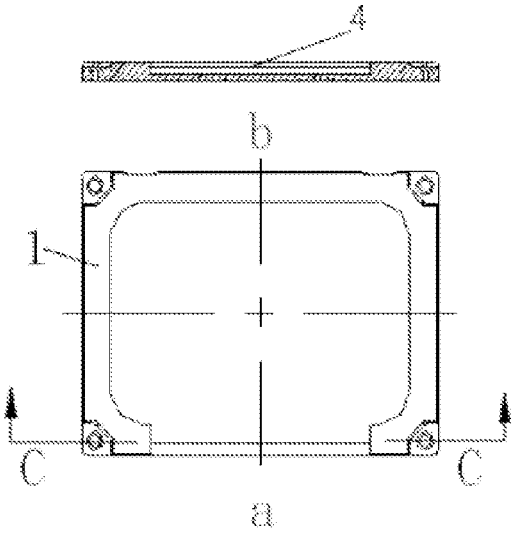
Figure 3D:
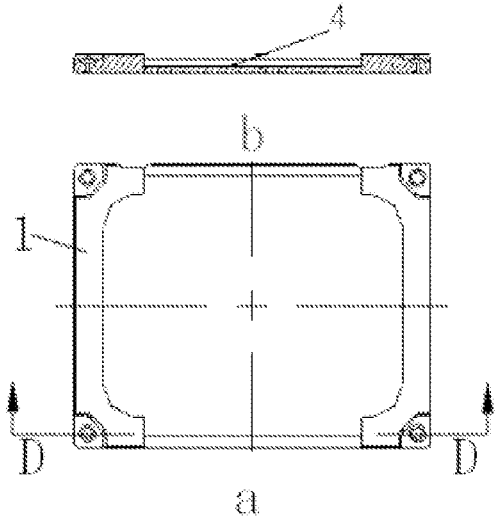

In the embodiment as shown in FIGS. 3Ca and 3Cb, there is only one sound hole in the speaker sound hole device, there is one open groove 4 provided at one of the long sides of the front cover of the speaker unit, and the open groove is a relatively large open groove, that is, the open groove is larger than the open groove at the long sides as shown in FIG. 3A and FIG. 3B. In the embodiment as shown in FIG. 3D, only one sound hole is provided in the speaker sound hole device, and there is one open groove 4 provided at each of the long sides of the front cover of the speaker unit, such that the gaps forming the sound channel is enlarged, which facilitates the front cavity to emit sound smoothly, thereby effectively improving the sound effect of the product.

Figure 4A:
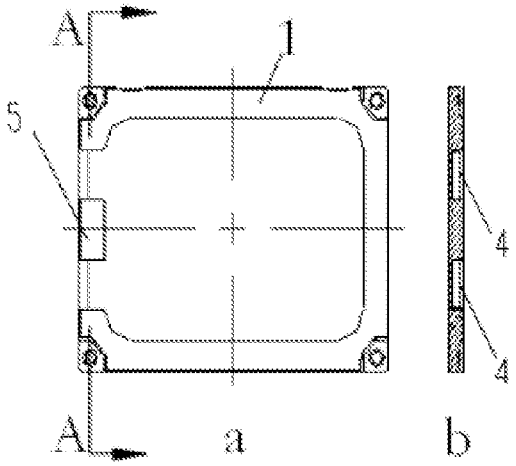
FIGS. 4Aa, 4Ba, 4Ca and 4Da are schematic views illustrating the front cover of the speaker according to the embodiment of the present application, respectively.

In the embodiment as shown in FIGS. 4Aa and 4Ab, as can be seen, there is only one sound hole in the speaker sound hole device, and there are two open grooves 4 provided at one of the short sides of the front cover of the speaker unit, and the speaker unit is mounted based on the mounting direction holes 5 for the speaker unit, and only one mounting direction hole 5 for the speaker unit is provided at one of the short sides of the front cover of the speaker unit, and thus, when the speaker unit is being mounted, the mounting direction of the speaker unit is determined based on the mounting direction hole 5 for the speaker unit.

Figure 4B:
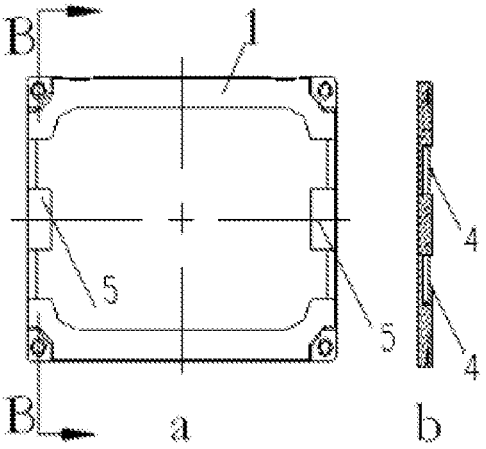

In the embodiment as shown in FIGS. 4Ba and 4Bb, there is only one sound hole in the speaker sound hole device, and there are two open grooves 4 provided at each of the short sides of the front cover of the speaker unit, that is, there are four open grooves 4 in total, and the mounting direction holes 5 for the speaker unit are provided at each of the short sides of the front cover of the speaker unit, respectively. In the embodiment as shown in FIG. 4B, two mounting direction holes 5 for the speaker unit are provided, and thus, when the speaker unit is being mounted, the mounting direction of the speaker unit does not need to be determined based on any directions.

Figure 4C:
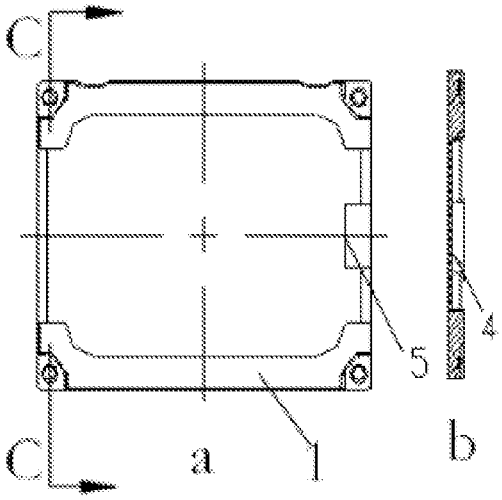

In the embodiment as shown in FIGS. 4Ca and 4Cb, there is only one sound hole in the speaker sound hole device, and there is one open groove 4 provided at each of the short sides of the front cover of the speaker unit, that is, there are two open grooves 4 in total, and one mounting direction hole 5 for the speaker unit is provided at one of the short sides of the front cover of the speaker unit, and thus, when the speaker unit is being mounted, the mounting direction of the speaker unit needs to be determined based on the mounting direction hole 5 for the speaker unit.

Figure 4D:
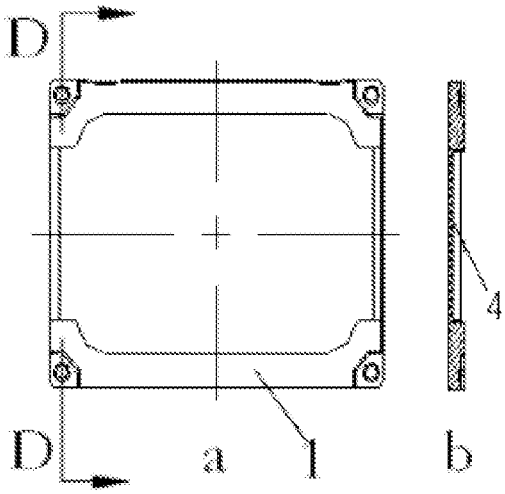

In the embodiment as shown in FIGS. 4Da and 4Db, there is only one sound hole in the speaker sound hole device, and there is one open groove 4 provided at each of the short sides of the front cover of the speaker unit, that is, there are two open grooves 4 in total, such that the gaps of the sound channel is enlarged, which facilitates the front cavity to emit sound smoothly, thereby effectively improving the sound effect of the product.

In addition, in the present application, according to the requirements of the specific design of the product, when there are two sound holes provided in the speaker sound hole device, one open groove, or two or four open grooves may be provided at the long side of the front cover of the speaker unit; and meanwhile, one open groove, or two or four open grooves may be provided at the short side of the front cover of the speaker unit.

That is, the number of the open grooves at the long side or short side of the front cover of the speaker unit may be determined according to the requirements of the speaker sound hole device product. The more the open grooves are, the more smoothly the front cavity of the speaker sound hole device emits sound, which may better improve the sound effect of the product.

As shown in FIG. 1, the open groove 4 at the long side or short side of the front cover 1 of the speaker unit is correspondly assembled with the module housing 2, and the front cavity 7 of the speaker sound hole device, which is formed by assembling the front cover 1 of the speaker unit with the module housing 2, is in communication with the open groove 4 provided on the front cover 1 of the speaker unit, and thus, a sound channel is formed by the front cavity 7 and the open groove 4. As can be seen from the embodiment in FIG. 1 obviously, the gap 6 of the sound channel is 0.76 mm, and the gap of the sound channel is: the distance from the module housing to the bottom of the open groove on the front cover of the speaker unit, that is, the gap 6 of the sound channel is the sum of the distance 61 from the top to the bottom of the open groove and the distance from the front cover of the speaker unit to the module housing, wherein the distance from the top to the bottom of the open groove (i.e., the depth of the open groove) is 0.44 mm.

It should be noted that open grooves are provided on the front cover of the speaker unit, and the open groove is correspondingly matched and assembled with the module housing 2 so as to form a sound channel. Meanwhile, the lateral sound hole may be formed on the module housing. Thus, by using the embedded structure of the speaker unit which is applied to the module housing emitting sound at lateral side, it may enable that the module housing may be assembled with the speaker unit directly, thereby improving production efficiency and lowering costs.

As can be seen from the above exemplary embodiment, the speaker unit and the module housing may be assembled together, and at this time, the front cover of the speaker unit is a front cover provided with open grooves, and the gap of the sound channel formed by the front cover of the speaker unit which is provided with open grooves and the module housing 2 is larger than the gap of the sound channel formed by conventional front cover of the speaker unit and the module housing.

Particularly, the gap of the sound channel formed by a conventional front cover of the speaker unit and a module housing is only 0.32 mm. However, the gap of the sound channel formed by the front cover of the speaker unit, which is provided with open grooves according to the present application, and the module housing 2 is 0.76 mm, and the gap of the sound channel of 0.76 mm is much larger than that of 0.32 mm. This is because a conventional front cover of the speaker unit is not provided with open grooves, and the distance of the sound channel is: the distance between the front cover of the speaker unit and the module housing. However, open grooves are provided on the front cover of the speaker unit according to the present application, and the distance of the sound channel is: the sum of the distance from the front cover of the speaker unit to the module housing and the distance 61 from the top to the bottom of the open grooves, that is, 0.32 mm+0.44 mm=0.76 mm. Thus, the design structure of the present application enables the maximization of the sound channel of the front cavity by adding open grooves in the case of the limitation on the overall height of the module housing 2, thus improving the performance of the speaker sound hole device and tone quality.

As can be seen from the above embodiments, in the speaker sound hole device provided by the present application, the design of the front cover of the speaker unit is optimized in such a way that open grooves are provided on the front cover so as to match with the module housing, which enables the front cavity to emit sound more smoothly, thus improving the performance of the speaker sound hole device and tone quality in the case of the limitation on the overall height of the module housing. Meanwhile, in the present application, the embedded structure of the speaker unit which is applied to the module housing emitting sound at lateral side enables that the module housing may be assembled with the speaker unit directly, thereby improving production efficiency and lowering costs.

As described above, the speaker sound hole device provided by the present application is described by way of example with reference to the accompanying drawings. However, it should be understood by those skilled in the art that various improvements can be made to the speaker sound hole device provided by the present application mentioned above without departing from the scope of the present application. Thus, the scope of the present application should be defined by the appended claims.

The invention claimed is:

1. A speaker sound hole device, comprising:

a front cover of a speaker unit and a module housing, wherein the front cover of the speaker unit is in a rectangular shape, and at least one open groove is provided at a long side and a short side of the front cover of the speaker unit, the front cover of the speaker unit is correspondingly assembled with the module housing through the open groove, a front cavity of the speaker sound hole device is formed by the front cover of the speaker unit, which is provided with the open groove, and the module housing, and a sound channel of the speaker sound hole device is formed by a space defined by the open groove together with the front cavity of the speaker sound hole device.

2. The speaker sound hole device according to claim 1, wherein two or four open grooves are provided at the long side and the short side of the front cover of the speaker unit.

3. The speaker sound hole device according to claim 1, wherein the front cover of the speaker unit is provided with mounting direction holes for the speaker unit.

4. The speaker sound hole device according to claim 3, wherein the number of the mounting direction holes for the speaker unit is one or two.

5. The speaker sound hole device according to claim 1, wherein a gap of the sound channel of the speaker sound hole device is a sum of a distance from a top to a bottom of the open groove and a distance from the front cover of the speaker unit to the module housing.

6. The speaker sound hole device according to claim 5, wherein the gap of the sound channel is about 0.76 mm.

* * * * *